US006590986B1

(12) United States Patent
Fazio

(10) Patent No.: US 6,590,986 B1
(45) Date of Patent: Jul. 8, 2003

(54) PATIENT-ISOLATING PROGRAMMING INTERFACE FOR PROGRAMMING HEARING AIDS

(75) Inventor: Joseph D. Fazio, Neshanic Station, NJ (US)

(73) Assignee: Siemens Hearing Instruments, Inc., Piscataway, NJ (US)

( * ) Notice: Subject to any disclaimer, the term of this patent is extended or adjusted under 35 U.S.C. 154(b) by 0 days.

(21) Appl. No.: 09/439,652

(22) Filed: Nov. 12, 1999

(51) Int. Cl.[7] ..... H04R 25/00

(52) U.S. Cl. ..... 381/314; 381/312; 381/323

(58) Field of Search ..... 381/312, 314, 381/315, 323, 60; 361/680, 681, 682, 683, 684, 685, 686

(56) References Cited

U.S. PATENT DOCUMENTS 5,619,396 A * 4/1997 Gee et al. ..... 361/686
6,424,722 B1 * 7/2002 Hagen ..... 381/314

FOREIGN PATENT DOCUMENTS

EP 0 853 443 A2 11/1997

OTHER PUBLICATIONS

*The Hearing Review*, vol. 4, No. 9, pp. 47–48 (Sep. 1997)
http://www.pretec.com/2sec_compactModemB.htm (Sep. 1, 1999).

* cited by examiner

*Primary Examiner*—Huyen Le
(74) *Attorney, Agent, or Firm*—Mark H. Jay; Joel Miller

(57) ABSTRACT

A programming interface for programming hearing aids is in PCMCIA compact flash format and meets the requirements of IEC 60601-1, type BF and UL 2601-1 when connected to a desktop or laptop computer.

4 Claims, 3 Drawing Sheets

PATIENT-ISOLATING PROGRAMMING INTERFACE FOR PROGRAMMING HEARING AIDS

BACKGROUND OF THE INVENTION

The invention relates to programmable hearing aids, and more particularly relates to devices used to program programmable hearing aids. In its most immediate sense, the invention relates to hearing aid programming interfaces that are designed for use with hand-held computers.

Programmable hearing aids are programmed by connecting them to a programming unit. One type of programming unit is a dedicated device that can only be used to program hearing aids. Another type of programming unit is a programming interface. A programming interface is a device connected between a computer and the hearing aids to be programmed. When a programming interface is used, the computer is loaded with appropriate software and the audiologist uses the software to issue commends to the programming interface. The programming interface then issues signals to the hearing aids, thereby programming them. The hearing aids are generally worn by the patient while they are connected to the programming interface.

At present, programming interfaces are of two general types. One type, which is the HI-PRO programming interface presently sold by the assignee Siemens Hearing Instruments, Inc., is designed for connection to a personal computer. Another type, which is exemplified by the EXPRESSfit programming interface now being sold by Sonic Innovations, Inc., is designed for connection to a battery-powered hand-held computer (the Palm Pilot, in this instance). These two types of programming interfaces are subject to different regulatory requirements. In the case of the Siemens HI-PRO programming interface, the personal computer can be connected to an unprotected source, e.g. the computer power supply can be connected to the electrical mains, and the computer modem can be connected to an unprotected telephone jack. Because of this, lightning strikes, electrical malfunctions within the computer, etc. can subject the programming interface to dangerously high currents, which in turn can shock or even electrocute the patient. For this reason, regulatory agencies require that this type of programming interface electrically isolate the patient from the computer.

In the case of the EXPRESSfit programming interface, applicable regulatory requirements are more lenient. Although the Palm Pilot computer can itself be connected to an unprotected source via a female jack for a modem connection or via a jack for a DC adapter, the EXPRESSfit device covers over these jacks when it is put into service. As a result, it is impossible for the Palm Pilot computer to be connected to an unprotected source while it is connected to the programming interface. For this reason, it is highly unlikely that any malfunctions in the Palm Pilot computer could produce any significant risk to the patient. For this reason, this type of programming interface need not isolate the patient from the computer.

Recent developments in the field of programming interfaces have brought about unanticipated problems. For example, Micro Ear Technology, Inc. of Plymouth MN makes a programming interface sold under the MICROCARD trademark. This programming interface is packaged as a PCMCIA card so it can fit into a hand-held computer such as the Apple MessagePad 2000. When so installed, the programming interface need not isolate the patient from the computer. However, PCMCIA cards can also be used with conventional personal computers (laptop and desktop units). Because audiologists and other hearing aid dispensers make extensive use of personal computers in their practices, dispensers can install the MICROCARD programming interface in a PCMCIA port in a laptop computer or in a PCMCIA adapter that is connected to a desktop computer. When so installed, the patient is not isolated from the computer and the dispenser is not in compliance with applicable regulations.

There is now a need for a programming interface that can be used with computers of all types. This is because dispensers use different types of computers for different purposes. For example, a dispenser may use a desktop computer when working in the office, may use a laptop computer when travelling to a factory to carry out a hearing conservation program, and may use a hand-held computer when working with patients at a nursing home. It would be advantageous if the dispenser could lawfully use the same programming interface with each of these computers, thereby eliminating the need to carry different devices for use with different computers.

One object of the invention is to provide a hearing aid programming interface that can be lawfully used with computers of all types.

Another object is, in general to improve on known hearing aid programming interfaces.

In accordance with the invention, a hearing aid programming interface is provided. The housing contains interface circuitry. A connector element conforming to the PCMCIA compact flash interface standard is mounted to the housing and permits the interface circuitry to be connected to a host computer. Means, mounted to the housing, are provided for connecting the interface circuitry to at least one hearing aid. A power supply is contained within the housing and supplies electrical power to the interface circuitry therein. The circuitry, the connecting means, and the power supply are electrically isolated from the host computer to prevent undesired stray currents from entering the patient while the host computer is connected to an unisolated power source, the patient is wearing said at least one hearing aid, and said at least one hearing aid is connected to the interface circuitry.

By using a connector element that complies with the PCMCIA compact flash interface standard, the invention can be used with hand-held computers because they all accept PCMCIA compact flash cards. And, because the compact flash standard is a subset of the PCMCIA standard, a compact flash card can be connected to a laptop computer through a PCMCIA slot using a compact flash adapter (which is quite inexpensive). (A compact flash adapter is an electrical connector mounted in a frame. The frame is sized to receive a compact flash card so that it is mated to the connector, and is also sized to fit into a standard PCMCIA slot so that the connector is mated to the PCMCIA port.) Furthermore, cards in PCMCIA format can be made available to the hardware in desktop computers by using commonly-available peripheral devices known as PCMCIA card readers. Hence, the invention makes it possible to easily and inexpensively connect a single programming interface to desktop, laptop, and hand-held computers, while remaining compliant at all times with applicable patient isolation requirements.

In the preferred embodiment, the power supply draws electrical power from the host computer to which the programming interface is connected. This avoids the need to have a separate power supply that must e.g. be connected to the electrical mains. Advantageously, in instances where the programming interface draws more power than can conveniently be taken from the host computer, a battery can be provided to supplement the power supply.

BRIEF DESCRIPTION OF THE DRAWINGS

The invention will be better understood with the aid of the illustrative and non-limiting drawings, in which.

DETAILED DESCRIPTION OF PREFERRED EMBODIMENTS

The following description assumes that fitting/programming software (such as that marketed through Siemens Hearing Instruments, Inc. under the CONNEXX trademark) is running on a computer. It is also assumed that a hearing aid dispenser wishes to use that software in the process of fitting the patient with at least one, but usually two, properly-programmed hearing aids. To do this, a programming interface is connected between the computer and the aid(s) to be programmed. Then, the dispenser operates the computer and causes the aid(s) to be programmed (and reprogrammed, if necessary) until the patient has been properly fitted.

Persons skilled in the art are familiar with such software and with the methods by which hearing aids are fit to the patient and programmed. For this reason, neither the software nor the fitting methodology will be described.

Figure 1:
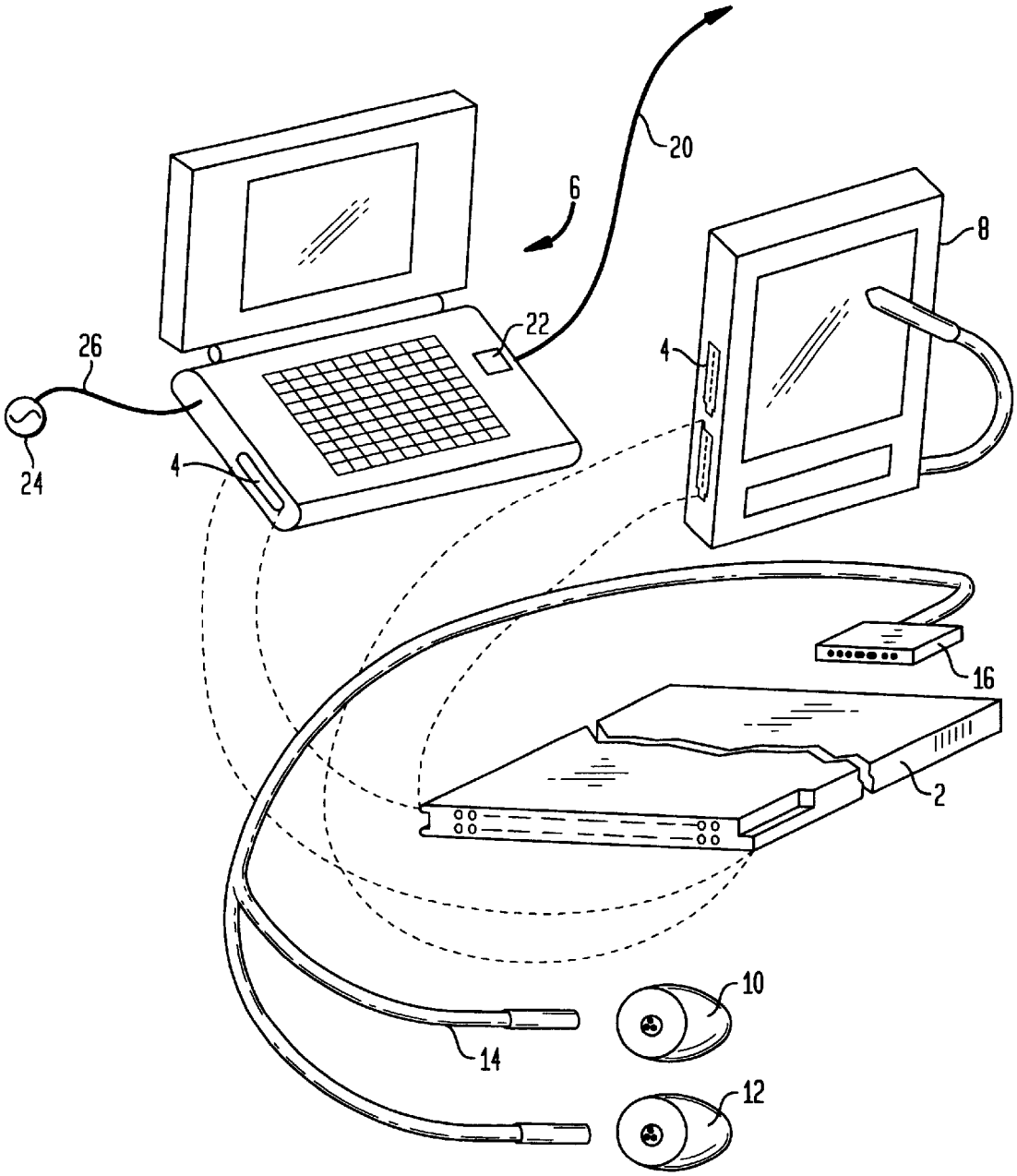
FIG. 1 shows a known programming interface in PCMCIA format.

Referring first to FIG. 1, it can be seen that a programming interface 2 in the format of a PCMCIA card can be plugged into a PCMCIA slot 4 in a desktop computer 6 or in a hand-held computer 8. Two hearing aids 10 and 12 can be connected to the programming interface 2 via cables 14 and a male connector 16 that can be plugged into a corresponding female connector (not visible) located in the programming interface 2.

This known programming interface 2, which is available from Micro Ear Technology, Inc. under the MICROCARD trademark, draws its power from the host computer (6 or 8) to which it is connected. While this poses no regulatory issues if the host computer is a hand-held computer 8, it does pose a regulatory issue if the host computer is a desktop computer 6. This is because a) the programming interface is not sufficiently well electrically isolated as to satisfy patient safety requirements established by IEC 60601-1, type BF in Europe and UL 2601-1 in the U.S. and b) the desktop computer 6 can be connected to unprotected sources. For example, the desktop computer 6 can be connected to a telephone line 20 via a modem 22 or to the electrical mains 24 via a power cord 26. Let it for example be assumed that lightning strikes the telephone line 20 or the electrical mains 24 while a patient (not shown) is wearing the hearing aids 10 and/or 12. In that event, a high voltage spike can propagate through the circuitry in the desktop computer 6, into and through the programming interface 2, into the hearing aids 10 and 12, and thence into the patient's body. This poses a risk of injury to the patient.

Although it might be possible to re-engineer the programming interface 2 so as to electrically isolate the patent in accordance with the above-identified regulations, this would certainly be very difficult and very expensive. This is because the above-identified regulations require that the programming interface 2 withstand a specific high voltage without any current leakage into the cables 14. To do this at a reasonable cost, an isolation transformer is required, and a conventional isolation transformer suitable to this task cannot be packaged in a PCMCIA format.

Figure 2:
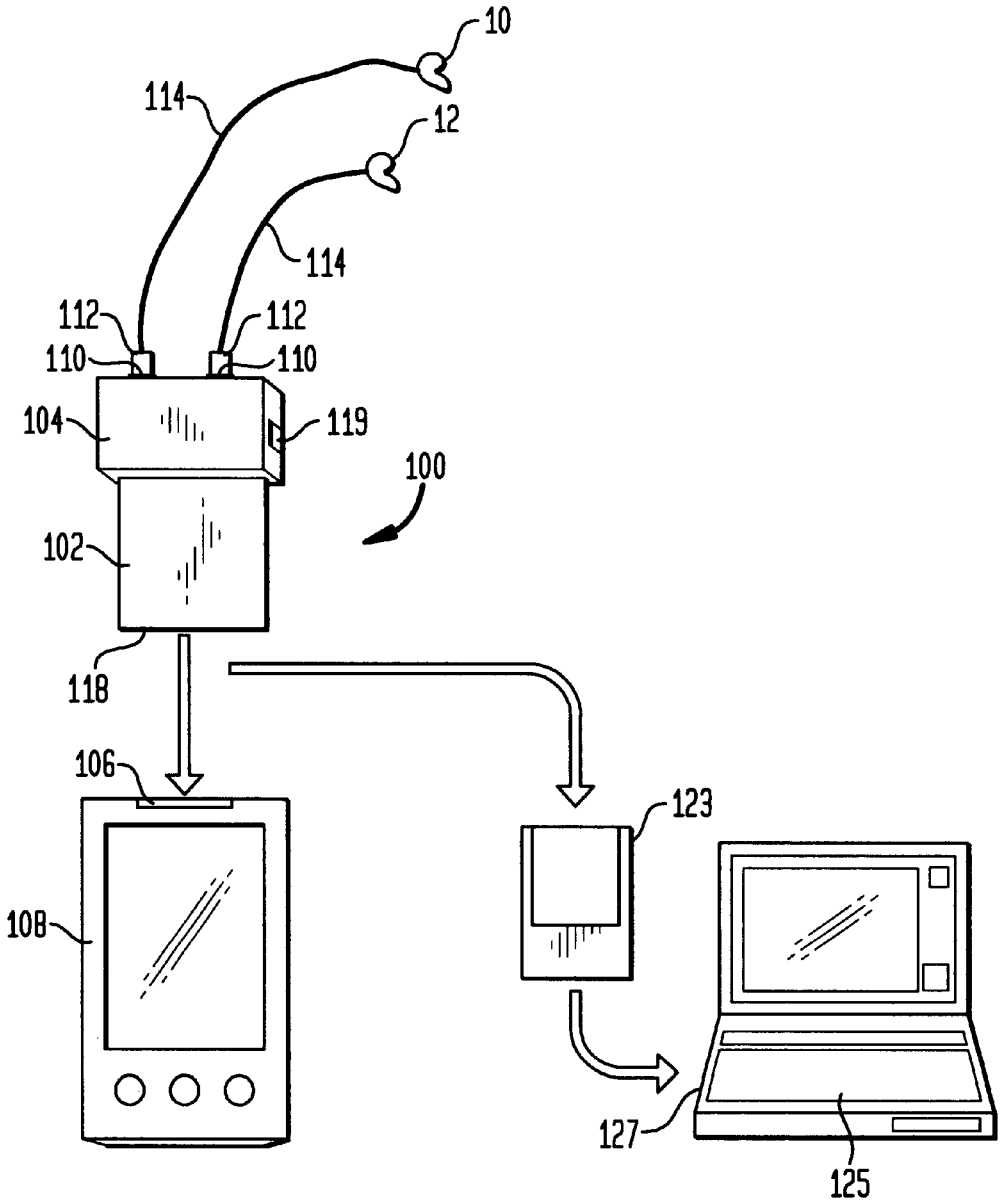
FIG. 2 shows the mechanical packaging of the preferred embodiment of the invention.
Figure 3:
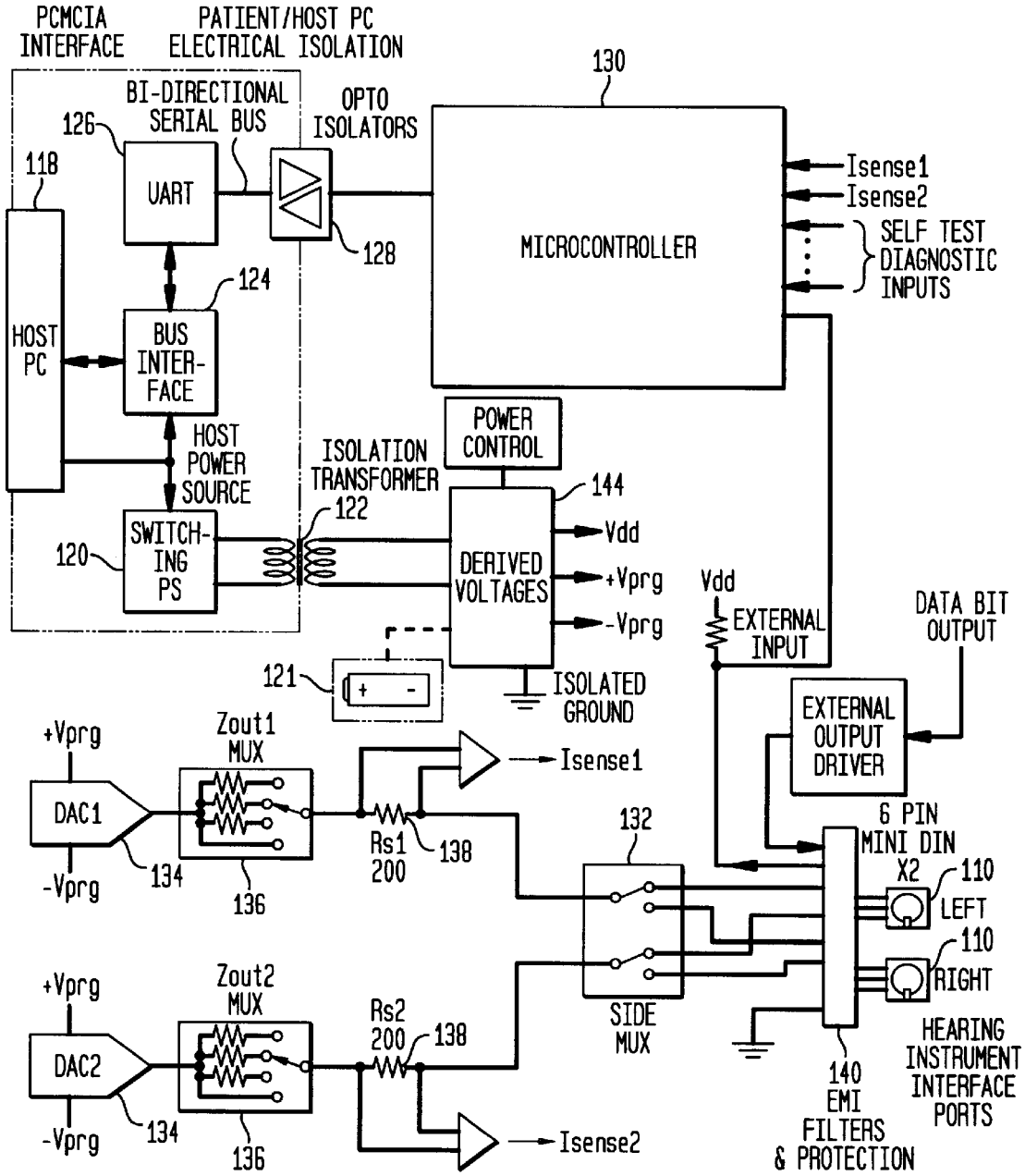
FIG. 3 shows a block diagram of the preferred embodiment of the invention.

The preferred embodiment of the invention will now be discussed with reference to FIGS. 2 and 3. Turning first to FIG. 2, a housing generally indicated by reference number 100 has an intromittent connector element 102 and an exterior element 104. The connector element 102 conforms to the PCMCIA compact flash standard and when introduced into a PCMCIA compact flash compliant slot 106 in a host computer 108 is electrically connected thereto. The preferred embodiment may optionally contain a battery compartment 119 in which a battery 121 (see FIG. 3) may be installed. A battery 121 may be required if design power requirements exceed host supply capabilities. Two female connectors 110 (which are advantageously of the 6 pin, mini DIN type) are mounted to the exterior element 104. Mating male connectors 112 and cables 114 can be used to connect one or two hearing aids 10, 12 to the preferred embodiment through the female connectors 110. Interface circuitry (not shown in FIG. 2) is used to program one or both of the hearing. aids 10, 12. If the preferred embodiment is to be used with a laptop or desktop computer, it can be plugged into a conventional PCMCIA flash card adapter 123, which in turn can be plugged into the laptop or desktop computer 125 containing a PCMCIA compliant slot 127.

To satisfy the requirements of the above-identified regulations, the preferred embodiment must be able to withstand specified high voltage without any leakage current into the cables 114 when the male connectors 112 are connected to the female connectors 110. This is accomplished by using the circuitry shown in FIG. 3.

The connector element 102 has a connector 118 at its distal end to make an electrical connection with the host computer 108. To provide electrical power for the preferred embodiment of the invention, a switching power supply 120 is supplied with current from the host computer 108 (not shown In FIG. 3). The switching power supply 120 is connected to the primary winding of an isolation transformer 122. The isolation transformer 122 provides the required electrical isolation. In this way, voltage spikes etc. will not be propagated into the preferred embodiment through the power supply circuitry, thereby also isolating the patient as required by the above-referenced regulations. Because the isolation transformer 122 is comparatively bulky and therefore cannot be mounted to the connector element 102, it is located in the exterior element 104.

As stated above, the battery 121 can be provided when the power requirements of the preferred embodiment exceed the power available from the host computer. The battery 121 is connected to power supply circuitry 144 and supplies electrical power thereto while the programming interface is in use.

The preferred embodiment of the invention also receives data from the host computer 108. This data comes through the connector 118, bus interface circuitry 124, and a UART 126. To isolate the preferred embodiment from voltage spikes propagated through the data bus circuitry, one or more opto isolators 128 are used. The opto isolator(s) 128 are located between the UART 126 and a microcontroller 130, and like the isolation transformer 122 they can easily provide required isolation without current leakage into the microcontroller 130.

It will thus be understood that in accordance with the preferred embodiment all the circuitry (and therefore the patient) is sufficiently isolated to meet the requirements of the above-identified regulations.

In accordance with the preferred embodiment of the invention, only one hearing aid (10 or 12) is programmed at one time. To program the hearing aids 10 and 12, a multiplexer 132 is used to select the particular hearing aid (10 or 12) to be programmed. Programming is carried out by generating appropriate analog signals using digital-to-analog converters 134, which supply the necessary clock and data signals. These signals are routed through multiplexers 136, which select a source impedance appropriate to program the particular hearing aids 10 and 12 that are to be programmed. (Different models of hearing aids are programmed differently.) The voltages across resistors 138 are used to read the input impedance of the hearing aids 10 and 12 and to thereby determine the models of the hearing aids 10 and 12 (so as to select the appropriate protocols to program them). A protective circuit 140 is used to prevent conducted EMI from interfering with the surrounding environment and to protect the circuitry from static discharge.

The preferred embodiment contains a provision for input of data from an external source (such as a control box operated by the patient during programming of the hearing aids 10 and 12). So, too, the preferred embodiment contains a provision for outputting data to an external display (such as a display to be viewed by the patient during programming of the hearing aids 10 and 12).

Although one or more preferred embodiments have been described above, the scope of the invention is defined only by the following claims:

What is claimed is:

1. A hearing aid programming interface, comprising:

a housing containing interface circuitry;

a connector element conforming to the PCMCIA compact flash interface standard, mounted to the housing and permitting the interface circuitry to be connected to a host computer;

means, mounted to the housing, for connecting the interface circuitry to at least one hearing aid;

a power supply, the power supply being contained with the housing and supplying electrical power to the interface circuitry therein; and means, within the housing, for electrically isolating at least the means for connecting the interface circuitry and the hearing aid, wherein the circuitry, connecting means, and power supply being electrically isolated from the host computer to prevent undesired stray currents from entering the patient while the host computer is connected to an unisolated power source, the patient is wearing said at least one hearing aid, and said at least one hearing aid is connected to the interfacing circuitry.

2. The programming interface of claim 1, further comprising a battery connected to the interface circuitry and supplying electrical power thereto when the interface circuitry is turned on.

3. The programming interface of claim 1, wherein the power supply draws electrical power from the host computer to which the programming interface is connected.

4. The programming interface of claim 1, wherein the means for electrically isolating comprises an isolation transformer and at least one optical isolator.

* * * * *